United States Patent [19]

Beery et al.

[11] Patent Number: 4,539,752

[45] Date of Patent: Sep. 10, 1985

[54] AUTOMATIC SHEET TRANSPORT MECHANISM

[75] Inventors: John C. Beery; Kenneth Witzke, both of Locust Grove, Va.

[73] Assignee: E.S.P. Systems, Inc., Locust Grove, Va.

[21] Appl. No.: 522,588

[22] Filed: Aug. 12, 1983

[51] Int. Cl.[3] ..... B43L 13/00

[52] U.S. Cl. ..... 33/18 B; 271/171; 271/258; 271/273; 101/416 R

[58] Field of Search ..... 400/636.2, 641, 708, 400/708.1, 707.2; 271/270, 272, 273, 274, 171, 258; 346/134; 101/416 R, 420, 421; 33/18 B

[56] References Cited

U.S. PATENT DOCUMENTS

| | | | |
|---|---|---|---|
| 1,930,511 | 10/1933 | Davidson | 101/279 |
| 2,185,424 | 1/1940 | Anderson | 400/618 X |
| 3,058,416 | 10/1962 | Grant et al. | 101/421 |
| 3,519,117 | 7/1970 | Smith | 400/636.2 X |
| 3,589,710 | 6/1971 | Yagi | 271/171 X |
| 3,618,934 | 11/1971 | Germuska | 271/274 |
| 3,936,041 | 2/1976 | Shiina et al. | 271/258 X |
| 4,046,372 | 9/1977 | Ebner | 271/273 |
| 4,268,021 | 5/1981 | Rutishauser et al. | 400/636.2 X |

FOREIGN PATENT DOCUMENTS

| | | | |
|---|---|---|---|
| 2910319 | 10/1979 | Fed. Rep. of Germany | 33/18 B |
| 0122566 | 9/1979 | Japan | 271/270 |
| 0031742 | 3/1980 | Japan | 271/258 |

OTHER PUBLICATIONS

IBM Technical Disclosure Bulletin "Sheet-Feed Sensing" by Korte et al., vol. 20, No. 1, 6/77, pp. 25, 26.

*Primary Examiner*—Paul T. Sewell
*Assistant Examiner*—John A. Weresh
*Attorney, Agent, or Firm*—Larson and Taylor

[57] ABSTRACT

An automatic sheet transport mechanism for precisely positioning a sheet relative to an automatic signature writing machine or the like is disclosed. A writing instrument is located vertically above a flat writing surface upon which the sheet rests and is movable into and out of engagement with the writing surface in a defined writing area. A sheet positioning device accurately positions the sheet laterally on the writing surface. A sheet feeding device is also provided for moving a single sheet from a stack of sheets and for advancing the single sheet to the sheet positioning device. A control device cyclically operates the transport mechanism so that the single sheet is moved by the sheet feeding device and sheet positioning device to the writing area of the writing surface where the writing takes place and thereafter the sheet positioning device is actuated to move the single sheet off of the writing surface so that the cycle can be repeated. Preferably, the sheet feeding device is adjustable longitudinally of the writing surface so that the sheet is fed to the sheet positioning device with the area of the sheet to be written on longitudinally aligned with the writing area of the writing surface.

15 Claims, 3 Drawing Figures

AUTOMATIC SHEET TRANSPORT MECHANISM

FIELD OF THE INVENTION

The present invention relates generally to the positioning of a sheet relative to a work area, and more particularly to the precise positioning of a sheet flat against a flat work surface.

BACKGROUND OF THE INVENTION

Current automatic signature machines have the writing pantographs suspended above the surface of the document to be written on. Because the pantographs are designed to write in a coordinate X-Y plane over a limited area, such pantographs must write on perfectly flat surfaces. Therefore, for an automatic machine of this type, the documents must be singly moved on to and off of a flat surface located below the pantographs. However, it is necessary to make certain that the document does not interfere with the support mechanism of the pantographs system. This has been accomplished by cantilevering the pantograph far enough away so that any desired size document can freely be positioned under the pantograph and so that writing can be applied to any portion of the document.

It should also be appreciated that each document in a stack of documents to be written on will have a common fixed writing area. However, the particular area to be written on for any document may be located at any position on the document, and vary both laterally and longitudinally from one set of documents to the next. It therefore becomes necessary to make it possible to adjust both the X and Y position of the document before it can be written on. Any automatic transport mechanism for documents must also be certain not to skew the document in any manner as the document is delivered to the writing surface.

One prior art delivery mechanism for an automatic signature machine utilized a series of documents which were connected edge to edge and which included perforated sides. These perforated sides engaged mating pin feed tractors located adjacent the pantograph system so that each document of the connected series could be accurately positioned beneath the pantograph. However, the documents produced by such an automatic signature machine contained a tear mark where the documents were separated and the performated strips removed so that these documents had the distinct appearance of the being mass produced which was undesirable. In addition, the recent widespread adaption of single feed work processors has resulted in the virtual abandonment in many applications of connected sheets.

Therefore, there existed in the prior art a need for a sheet transport mechanism to automatically position a single sheet from a stack of similar sheets beneath a pantograph system.

SUMMARY OF THE INVENTION

An automatic sheet transport mechanism for precisely positioning a sheet relative to an automatic work machine, such as a paper sheet for an automatic signature machine, is disclosed. The automatic sheet transport mechanism for an automatic signature machine includes a flat, rectangular writing surface which is disposed in a horizontal plane and upon which the sheet rests as it is being written on. The writing surface includes longitudinal sides, a leading lateral side, and a trailing lateral side. A writing instrument is located vertically above the writing surface and is movable into and out of engagement with the writing surface in a defined writing area. The writing instrument preferably writes in a generally lateral direction relative to the writing surface in the writing area.

The automatic sheet transport mechanism also includes a sheet positioning means for accurately positioning the sheet on the flat writing surface. The sheet positioning means includes a leading driving roller and a trailing driving roller located adjacent respective leading and trailing sides of the writing surface. Each of the elongate driving rollers has a top edge tangent to the horizontal plane of the writing surface. A motor means is provided for rotating the rollers so that the top edge of the leading roller rotates toward the writing surface and the top edge of the trailing roller rotates away from the writing surface. A leading shaft and trailing shaft are located vertically above the respective leading and training rollers and have a pair of leading wheels and a pair of trailing wheels respectively mounted thereon. These wheels are freely rotatable on the shafts and positionable longitudinally relative to the shafts. The wheels engage the respective rollers so that the rotation of the rollers cause any sheet located therebetween to move laterally relative to the writing surface.

The automatic sheet transport mechanism further includes a sheet feeding means positioned adjacent the leading side of the writing surface. The sheet feeding means removes a single sheet from a stack of similar sheets and advances the single sheet between the leading roller and associated leading wheels. Finally, a control means cyclically controls the actuation of the motor means, the sheet feeding means, and the writing instrument. Thus, the single sheet from the stack is moved by the sheet feeding means and sheet positioning means to the writing area of the writing surface where the writing instrument writes the desired message. Thereafter, the sheet positioning means is actuated to move the single sheet off of the trailing side of the writing surface and the cycle is then repeated.

It is an important advantage of the present invention that the sheet which is being written or worked upon is kept flat against the writing surface. This is accomplished by use of a number of features. For example, the leading driving roller rotates slightly slower than the trailing driving roller during advancement of the sheet along the writing surface. In this manner, the sheet is pulled taut as soon as the sheet is positioned between both rollers and associated wheels.

In addition, a particular mounting means for the leading shaft and trailing shaft is provided to keep the sheet flat. This mounting means prevents the leading and trailing shafts from moving horizontally but allows the shafts to move freely vertically. In this manner, the wheels support the shafts vertically and the pressure exerted by the wheels on the respective driving rollers and the sheet fed therebetween is equal and determined by the weight on the wheels. Therefore, by carefully choosing the weight of the mounting means, the pressure exerted on the sheet which is fed between the wheels and the rollers can be carefully adjusted. By careful adjustment, this pressure is sufficient to positively drive the sheet, but not so great or too little so as to cause buckling or skewing of the sheet as it is transported. Furthermore, the shafts are also preferably freely rotatable to assure that there is no resistance to movement of the sheet beneath the wheels. The mounting means preferably includes a base, a pair of opposed bars located adjacent the longitudinal sides of the writing surface and to which the shafts are rotatably mounted, and a pair of pins extending downwardly from these bars which are received in respective bores located in the base.

In order to hold the sheet flat against the writing surface, a hold-down strip is also preferably provided. This hold-down strip extends generally parallel to the writing surface in a lateral direction and exerts a slight downward pressure on the writing surface. The hold-down strip is located in a position adjacent to the writing area to keep that area of the sheet especially flat. Conveniently, the hold-down strip is attached to the leading shaft in such a manner as to be adjustable along the shaft. In addition, the hold-down strip is resilient and the pressure exerted by the hold-down strip is adjustable by rotating the attaching piece about the leading shaft to vary the angle at which the hold-down strip depends from the attaching means and hence the pressure exerted on the writing surface.

Where the sheet transport mechanism of the present invention is for an automatic signature machine, a protective strip is also provided adjacent the area where the writing instrument rests during sheet transport. This is to protect the sheet underneath the protective strip from ink dropping from the writing instrument and from any inadvertent paper buckling which might cause the raised paper to contact the writing instrument. The protective strip works in much the same manner as the hold-down strip to hold the sheet flat. However, so as not to interfere with the writing on the sheet, the protective stip is much shorter than the hold-down strip.

In order to assure that the correct longitudinal portion of the sheet is fed to the writing area of the writing instrument, an adjusting means is provided for adjusting the sheet feeding means longitudinally of the writing surface. In this manner, the sheet is fed to the sheet positioning means with the proper area of the sheet longitudinally aligned with the writing area. In the preferred embodiment, an elongate deflector plate is also provided with the sheet feeding means. This deflector plate is mounted with one longitudinal edge adjacent and slightly above the leading driving roller and the other longitudinal edge adjacent the uppermost reach of the stacked sheets which are provided in the sheet feeding means. In this manner, any sheet fed from the stack by the sheet feeding means is deflected by the deflector plate and delivered between the leading driving roller and the leading wheels.

Besides properly positioning the sheet longitudinally, it is also necessary to properly position the sheet laterally. In order to accomplish this, the control means includes a sensing means for sensing the leading edge of the sheet relative to a known lateral position on the writing surface or writing area. An encoder means is also provided for determining the incremental rotational displacement of the leading driving roller, and hence the advancement of the leading edge of the sheet relative to the writing area. Finally, a stopping means is provided for stopping the rotation of the leading and trailing driving rollers by the motor upon the completion of a predetermined rotational displacement of the leading driving roller after detection of the leading edge of the sheet by the sensing means. Conveniently, the stopping means is an electromagnetic brake for the motor driving the leading and trailing driving rollers. In this manner, the sheet is accurately laterally positioned on the writing surface with the portion of the sheet to be written on laterally located at the writing area of the writing surface.

In the preferred embodiment, the sensing means also senses the trailing edge of the sheet after the writing on the sheet has been accomplished. In this manner, the control means then actuates the sheet feeding means so that a new sheet is delivered to the writing area.

In case of running out of sheets, jamming or the like, the control means further includes a time delay means for shutting off the sheet feeding means and sheet positioning means. This time delay is actuated by the sensing means when the leading edge of a succeeding sheet is not detected by the sensing means within a predetermined time period after detection by the sensing means of the passing of the trailing edge of a preceeding sheet.

Other features and advantages of the present invention are stated in or apparent from a detailed description of a presently preferred embodiment of the invention found hereinbelow.

DETAILED DESCRIPTION OF THE PREFERRED EMBODIMENT

Figure 1:
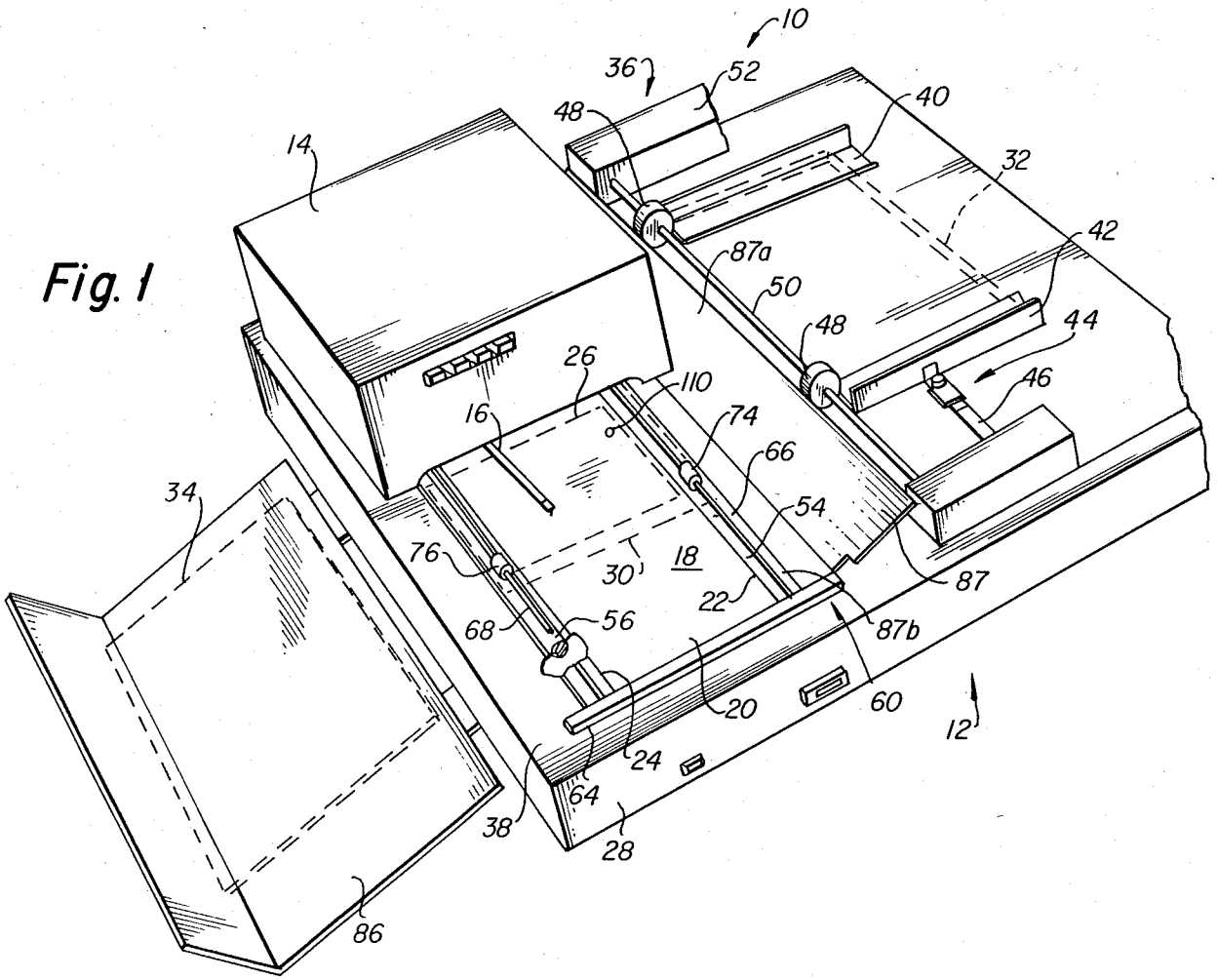
FIG. 1 is a perspective view of the automatic sheet transport mechanism of the present invention in use with an automatic signature writing machine.
Figure 2:
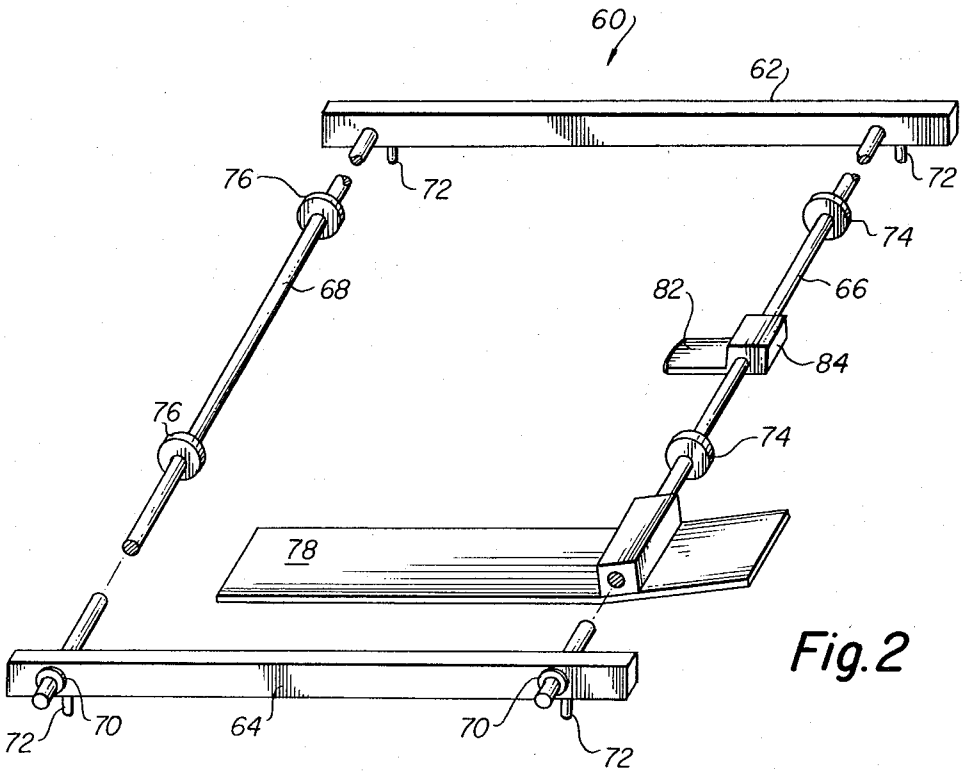
FIG. 2 is a perspective view of the mounting means for the shafts of the sheet positioning means depicted in FIG. 1.

With reference now to the drawings in which like numerals represent like elements throughout the several views, an automatic signature machine 10 incorporating an automatic sheet transport mechanism 12 according to the present invention is depicted in FIGS. 1 and 2. Automatic signature machine 10 includes a pantograph system 14 which is used to write a particular message or indicia by means of a writing instrument 16. Pantograph systems 14 are known in the art and are used to carefully write a predetermined message on an underlying sheet of paper. Pantograph system 14 depicted in FIG. 1 is an ESP system by Signature Systems, Inc. of Manassas, Va. This system is the subject of two U.S. patents, No. 3,733,612 (Huston et al) and No. 3,582,956 (Huston et al), which patents are herein incorporated by reference. In use, pantograph system 14 carefully writes a predetermined message with writing instrument 16. After the message is completed, writing instrument 16 is raised slightly above the sheet of paper and moved to a rest position adjacent the front end of pantograph system 14. Conveniently, writing instrument 16 includes a liquid ink feed stylus.

Pantograph system 14 also includes a writing surface 18 upon which the sheet rests. Writing surface 18 includes a longitudinal end 20, an opposite longitudinal end (not shown), underneath of pantograph system 14, a leading lateral side 22, and a trailing lateral side 24. Writing surface 18 is generally disposed in a horizontal plane. Due to the constraints of pantograph system 14, only a specified writing area 26 on writing surface 18 can be written on by pantograph system 14 and writing instrument 16. It should be appreciated that pantograph system 14 is relatively immovably mounted on a base 28.

Automatic sheet transport mechanism 12 of the present invention is used to automatically and cyclically deliver a sheet 30 to writing surface 18 from a stack of sheets 32, and subsequently after sheet 30 has been written on to move sheet 30 from writing surface 18 to an accumulating stack 34. Two basic devices are used to accomplish this, a sheet feeding means 36 and a sheet positioning means 38.

Sheet feeding means 36 is a corner tab separator manufactured by the A. B. Dick Company which is commonly used on mimeograph machines and which is suitably modified for use in the present invention. Sheet feeding means 36 includes right angle flanges 40 and 42 between which the stack of sheets 32 is located. Both flanges 40 and 42 are longitudinally adjustable on base 28 by a suitable means such as a locking screw mechanism 44 shown in a track 46 adjacent flange 42. In this manner, flanges 40 and 42 are easily adjustable for the size of sheets contained in the stack of sheets 32. Each separate sheet is fed off of the stack of sheets 32 by wheels 48 which are rotated by means of a shaft 50. Shaft 50 is suitably actuated when desired by an electric motor contained in housing 52.

It should be appreciated that flanges 40 and 42 are also adjustable longitudinally of base 28 to determine the longitudinal position of the delivered sheet 30 as sheet 30 is advanced laterally by sheet feeding means 36. For this reason, wheels 48 are also adjustable longitudinally along shaft 50 to the desired location relative to flanges 40 and 42. In this manner, almost any size sheet 30 can be contained in a stack of sheets 32 and delivered to writing surface 18 with the portion of sheet 30 to be written on longitudinally aligned with writing area 26 of pantograph system 14.

Sheet positioning means 38 receives sheet 30 from sheet feeding means 36 and properly positions sheet 30 laterally on writing surface 18. Sheet positioning means 38 includes a leading driving roller 54 and a trailing driving roller 56. As shown in FIG. 1, rollers 54 and 56 are located adjacent lateral sides 22 and 24, respectively, of writing surface 18. In addition, it should be appreciated that the top or uppermost peripheral edges of rollers 54 and 56 are at the same level as writing surface 18. Preferably, rollers 54 and 56 are about 18" long, have a diameter of about 1", and are made of vulcanized rubber. Driving rollers 54 and 56 are suitably driven by a single motor contained in base 28 through a timing gear/belt arrangement. However, leading driving roller 54 is rotated slightly slower than trailing driving roller 56 for a reason to be explained subsequently.

As shown in greater detail in FIG. 2, sheet positioning means 38 includes an idler mechanism 60. Idler mechanism 60 includes a pair of bars 62 and 64. Extending between each end of bars 62 and 64 are a leading shaft 66 and a trailing shaft 68. Shafts 66 and 68 are suitably mounted in bars 62 and 64 by shaft retaining clips 70 so as to be freely rotatable relative to bars 62 and 64. Depending at each end of bars 62 and 64 are pins 72. Pins 72 are freely received in correspondingly sized bores (not shown) provided in base 28 so as to be oriented as depicted in FIG. 1. In this orientation, leading shaft 66 is disposed directly above leading driving roller 54, and trailing shaft 68 is disposed directly above trailing driving roller 56. In addition, the precise positioning of pins 72 keep shafts 66 and 68 parallel with one another and rollers 54 and 56.

As shown best in FIG. 2, a pair of leading wheels 74 and trailing wheels 76 are rotatably mounted on leading shaft 66 and trailing shaft 68, respectively. Wheels 74 and 76 are freely rotatable on shafts 66 and 68, respectively. In addition, wheels 74 and 76 are frictionally held in place along the longitudinal length of shafts 66 and 68, respectively, so that wheels 74 and 76 are movable along the lengths of shafts 66 and 68 as desired.

It should be appreciated that wheels 74 and 76 normally rest on top of rollers 54 and 56, respectively, and act as idlers. The pressure with which wheels 74 and 76 contact rollers 54 and 56 is determined by the weight of idler mechanism 60. As mentioned above, idler mechanism 60 is held in place horizontally by means of pin 72. However, idler mechanism 60 is free to move vertically. Therefore, wheels 74 and 76 support the entire weight of idler mechanism 60, so that the pressure exerted by wheels 74 and 76 on rollers 54 and 56 is determined by the weight of idler mechanism 60. The weight of idler mechanism 60 is specifically chosen so that when sheet 30 is located between respective wheels 74 and 76 and rollers 54 and 56, sheet 30 is positively driven but is not caused to buckle or skew due to distortion of rubber rollers 54 and 56. In addition, the construction of the idler mechanism 60 assures that wheels 74 and 76 contact respective rollers 54 and 56 with the same pressure to prevent skewing of sheet 30 as sheet 30 is moved by sheet positioning means 38.

Referring to FIG. 2, idler mechanism 60 also includes a hold-down strip 78 which extends generally parallel to writing surface 18 and out above leading driving roller 54. Hold-down strip 78 is made of resilient plastic material and is attached to leading shaft 66 by a suitable connector 80. Connector 80 has a bore therethrough in which leading shaft 66 passes so that connector 80 is frictionally held on shaft 66 but is relatively movable therealong and rotatable thereabout. In this manner, connector 80 can be longitudinally positioned at a location adjacent writing area 26 to hold sheet 30 flat against writing surface 18 without interferring with writing instrument 16. In addition, the pressure exerted by hold-down strip 78 can be adjusted by rotating connector 80 about leading shaft 66. Thus, as viewed in FIG. 2, rotation of connector 80 counterclockwise as shown increases the pressure exerted by hold-down strip 78 against the underlying sheet 30. It should be noted that hold-strip 78 and connector 80 have been omitted from FIG. 1 for clarity.

Also mounted on leading shaft 66 in a manner similar to hold-down strip 78 is a protective strip 82. Protective strip 82 is attached to leading shaft 66 by a suitable connector 84 which is similar to connector 80 and which allows protective strip 82 to be adjustable along leading shaft 66 both longitudinally and rotatably. Although protective strip 82 does exert a laterally limited pressing down on sheet 30 to hold sheet 30 flat against writing surface 18, protective strip 82 is preferably located at the rest position of writing instrument 16 to prevent any ink drippings from writing instrument 16 from falling on an underlying sheet 30. In addition, any tendency of sheet 30 to buckle up into engagement with writing instrument 16 during transport of sheet 30 is also prevented. As with hold-down strip 78, protective strip 82 has been omitted from FIG. 1 for clarity.

As shown in FIG. 1, a deflector 87 is positioned between sheet feeding means 36 and sheet positioning means 38. Deflector 87 has a leading lateral edge **87*a* positioned somewhat above the highest position which the stack of sheets 32 can occupy. In addition, deflector 87 has a trailing lateral edge 87***b* which is vertically located above and adjacent to the top edge of leading driving roller 54, and below the outer end of hold-down strip 78. Thus, it can be seen that deflector 87 assures that no matter what height on the stack of sheets 32 the single sheet 30 to be transported is taken, the leading edge is deflected so as to be delivered at the pinch point between leading driving roller 54 and leading wheels 74, and underneath of hold-down strip 78 without jamming.

Attached to base 28 adjacent trailing driving roller 56 is an accumulator 86. Accumulator 86 is angled downwardly from base 28 so that sheets 30 which have been written on by pantograph system 14 are fed from sheet positioning means 38 and form accumulating stack 34.

Figure 3:
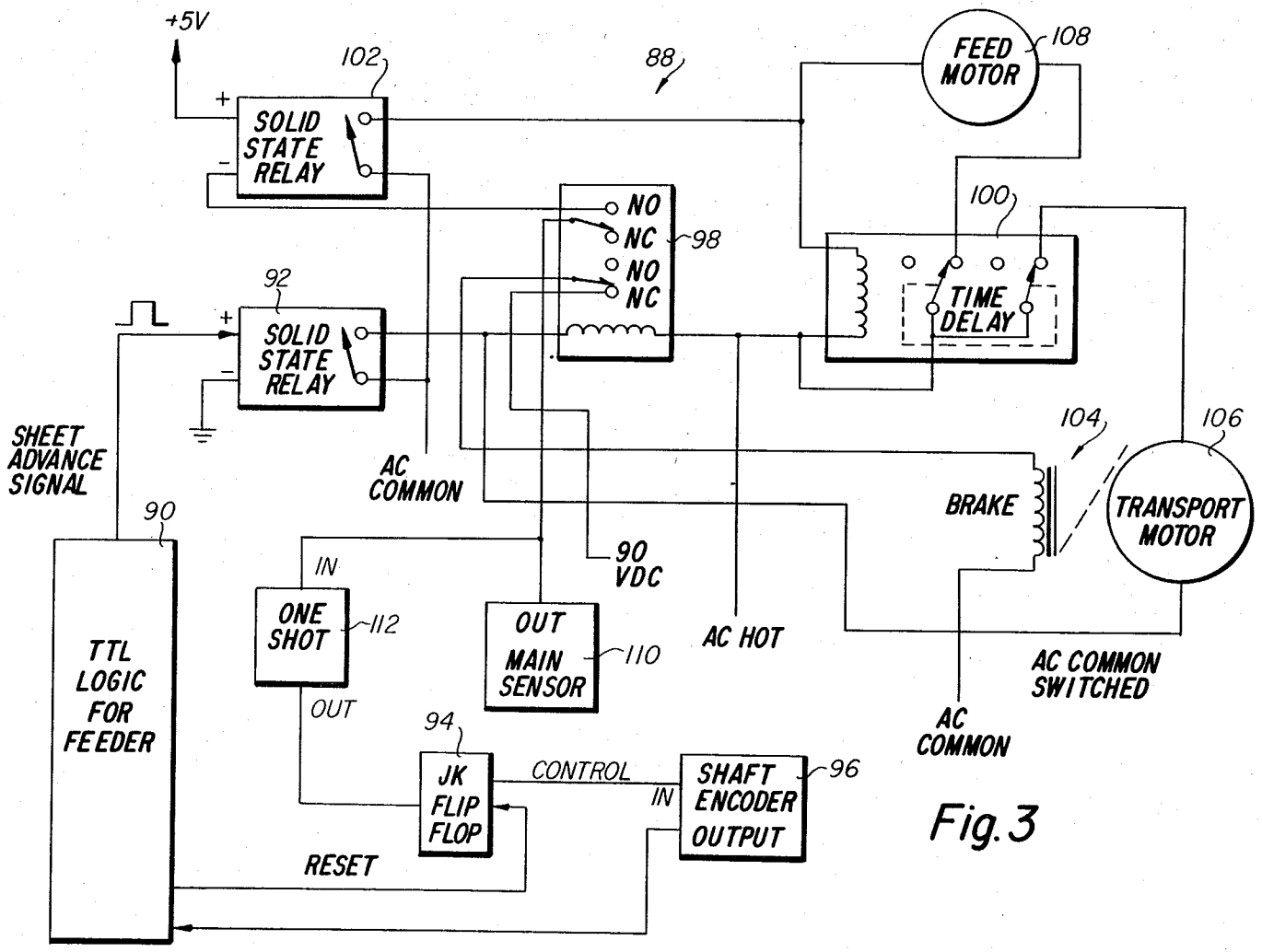
FIG. 3 is a schematic control circuit diagram of the mechanism depicted in FIG. 1.

In order to control the operation of automatic signature machine 10 and automatic sheet transport mechanism 12, a suitable control means 88 is provided as depicted schematically in FIG. 3. Control means 88 is depicted in the ready state where sheet 30 is being written on by pantograph system 14. Control means 88 includes TTL logic 90 which is connected to a solid state relay 92, a JK flip-flop 94, and a shaft encoder 96. Shaft encoder 96 is operatively connected to leading driving roller 54 and produces binary counts which correspond to incremental rotational displacements of leading driving roller 54. The incremental counts are designed to correspond to the incremental lateral advancement of sheet 30 across writing surface 18, in, for example, ⅛" increments. Therefore, a preselected number of increments corresponds to a preselected lateral advance of sheet 30. Solid state relay 92 is connected to relay 98 and a time delay relay 100. One set of switches in relay 98 is connected to a solid state relay 102 while the other set of switches is connected to an electro-magnetic brake 104. Time delay relay 100 is connected to transport motor 106 which drives rollers 54 and 56. When brake 104 is actuated, motor 106 is prevented from rotating rollers 54 and 56. Time delay relay 100 is also connected to feed motor 108 which drives shaft 50 and causes sheet feeding means 36 to feed a sheet 30 to sheet positioning means 38. The upper switch of relay 98 is also connected to a sensor 110. Sensor 110 is also depicted in FIG. 1 and is preferably an optical reflective switch which produces an output whenever sheet 30 is vertically above or covering sensor 110. Sensor 110 is connected to a one shot multivibrator 112 which is in turn connected to JK flip-flop 94 as shown.

The cycle of operation of automatic signature machine 10 and automatic sheet transport mechanism 12 is as follows. Initially, it is assumed that automatic signature machine 10 is in the cycle of operation depicted in FIG. 1 where writing instrument 16 is writing the desired message on sheet 30 which is resting on writing surface 18. At this time, the lower switch in relay 98 is closed so that brake 104 is actuated to prevent the rotating of rollers 54 and 56. In this manner, sheet 30 is held stationery as writing instrument 16 writes the message.

When the message has been written, writing instrument 16 is moved vertically upward slightly and over to the front side of pantograph system 14 to the rest position. As explained above, protective strip 82 is located at this rest position just below writing instrument 16. Once writing instrument 16 reaches the rest position, TTL logic 90 produces a sheet advance signal to actuate solid state relay 92. At the same time, a reset signal is sent to JK flip-flop 94. When the switch in solid state relay 92 closes, relay 98 is also actuated causing both switches to move from the normally closed to the normally opened positions. At the same time, the time delay in time delay relay 100 is actuated for a purpose to be explained subsequently. As soon as relay 98 is actuated, the lower switch is disconnected from the 90 volt source as shown so that brake 104 is deactivated. This causes transport motor 106 to immediately cause rollers 54 and 56 to rotate. As sheet 30 was pinched between rollers 54 and 56 and associated wheels 74 and 76, the rotation of rollers 54 and 56 cause sheet 30 to be moved laterally along writing surface 18 to accumulating stack 34 of accumulator 86.

The actuation of solid state relay 92 also causes the upper switch of relay 98 to be moved to the normally open position and complete the circuit to solid state relay 102. However, the +5 volt output of main sensor 110 prevents solid state relay 102 from operating. It should be appreciated that main sensor 110 produces a +5 volt output as long as sheet 30 is located vertically above main sensor 110. Thus, as sheet 30 moves toward accumulator 86, the trailing edge of sheet 30 passes beyond sensor 110. At this time, the output of sensor 110 goes to zero volts so that solid state relay 102 is actuated. Upon actuation of the switch of solid state relay 102, feed motor 108 is actuated. This causes sheet feeding means 36 to operate by rotation of shaft 50 and wheels 48. Thus, a new sheet 30 is taken from the stack of sheets 32, deflected by deflector 87, and delivered between leading driving roller 54 and leading wheel 74. With transport motor 106 still energized, the leading edge of sheet 30 is immediately advanced along writing surface 18.

As the leading edge of new sheet 30 passes over sensor 110, sensor 110 again produces an output and deactuates solid state relay 102. This opens a switch to feed motor 108 and feed motor 108 is deactivated so that only a single sheet 30 is delivered from sheet feeding means 36. The commencing of an output from sensor 110 also causes one shot multivibrator 112 to produce an output signal which sets JK flip-flop 94 which in turn enables shaft encoder 96. This signal causes shaft encoder 96 to commence counting the incremental angular displacements of leading driving roller 54. As the position of sensor 110 is known, the producing of a signal from sensor 110 which is received by shaft encoder 96 indicates that the leading edge of new sheet 30 is at a certain location so that further rotation of leading driving roller 54 is correlated by shaft encoder 96 to a precise movement of the leading edge of the new sheet 30 along writing surface 18. Shaft encoder 96 has previously been programmed to allow a certain advancement of the leading edge of new sheet 30 along writing surface 18 corresponding to a certain number of binary counts. When the leading edge of new sheet 30 reaches this position, shaft encoder 96 having produced all output count signals required to cause TTL logic 90 to switch off the signal being sent to solid state relay 92. When this occurs, the switch in solid state relay 92 is immediately opened and relay 98 is deenegized. The deenergization of relay 98 causes the lower switch to immediately close and brake 104 to be applied to transport motor 106. This in turn causes driving rollers 54 and 56 to be immediately stopped and sheet 30 precisely positioned laterally along writing surface 18. At this time, writing instrument 16 is again actuated and the message written on the new sheet 30 positioned on writing surface 18.

In the above described cycle of operation, when the output of sensor 110 dropped to zero so that solid state relay 102 is actuated to actuate feed motor 108, time delay relay 100 was also actuated. It is anticipated in normal operation that sensor 110 will again quickly be covered by a new sheet 30 and produce an output to deactivate solid state relay 102 and open the switch to feed motor 108 and time delay relay 100. Therefore, the time delay of time delay relay 100 is set at a period which is somewhat longer than the time it takes sheet feeding means 36 to deliver a new sheet 30 over sensor 110, for example, slightly greater than one second. However, when the stack of sheets 32 is depleted, or a jam occurs, it is desirous to turn off both transport motor 106 and feed motor 108. Thus, if such a situation occurs, main sensor 110 remains without an output as no new sheet 30 covers sensor 110. Therefore, solid state relay 102 remains activated and time delay relay 100 continues to operate. After the predetermined time period has elapsed and sensor 110 has not been covered and producing an output, time delay relay 110 is actuated and the switch is therein thrown. This deactivates both feed motor 108 and transport motor 106. Preferably, the time delay period is short enough to prevent multiple paper jams.

It should be appreciated that encoder 96 is used to properly position sheet 30 laterally along writing area 26 of writing surface 18. As mentioned above, in order to longitudinally space sheet 30, flanges 40 and 42 are moved to the appropriate locations where the stack of sheets 36 is contained between flanges 40 and 42, and the area to be written on of the sheets 30 of the stack of sheets 32 is longitudinally aligned with writing area 26 of writing surface 18. By use of sheet feeding means 36 which is adjustable along the longitudinal direction relative to writing surface 18, it should be appreciated that virtually any size of sheet 30 can be longitudinally positioned in the appropriate position.

It should be appreciated by those of ordinary skill in the art that various manual switches are also provided in automatic signature machine 10 to actuate the cycle of operation, including an initial actuation of sheet feeding means 36 to position the first sheet 30 at the appropriate location on writing surface 18. In addition, a suitable programming means is provided for encoder 96 to change the number of counts which produce a signal which corresponds to the desired lateral position of the leading edge of sheet 30 and a programming means is also provided for pantograph system 14 so that the message written thereby can be changed.

It should also be appreciated that a number of features of the present invention help to maintain sheet 30 taut and flat against writing surface 18 as the message is written by writing instrument 16. These features include hold-down strip 78 and protective strip 82. In addition, the rotation of trailing driving roller 56 somewhat faster than leading driving roller 54 also pulls the leading edge of sheet 30 away from the trailing portion which is pinched by leading driving roller 54 and leading wheel 74 to pull sheet 30 taut. It should be realized that the faster turning of trailing roller 56 also prevents bowing which might occur if the leading edge of sheet 30 was not received precisely at the pinch point between trailing roller 56 and trailing wheels 76 because the leading edge was turned up slightly. If both rollers 54 and 56 were turning at the same speed, bowing would result. However, as trailing roller 56 is turning faster, sheet 30 is instead immediately pulled taut as soon as the trailing edge of sheet 30 is received between trailing roller 56 and trailing wheels 76.

It should further be appreciated that the use of idler mechanism 60 provides for the uniform advancement of the leading edge of sheet 30 along writing surface 18 without skewing or bowing. The free rotation of wheels 74 and 76 in conjunction with the rotation of driving rollers 54 and 56 assures that no buckling or skewing forces are exerted on sheet 30. In addition, the free rotation of shaft 66 further reduce any bowing or skewing tendencies on sheet 30 which might arise due to any variations in diameters of wheels 74 and 76 caused by wear or the like.

The provision of a light weight idler mechanism 60 whose weight corresponds to a desired pressure exerted by wheels 74 and 76 on rollers 54 and 56 to prevent bowing and skewing of sheet 30 should also be appreciated.

While the present invention has been described with respect to an automatic signature machine 10 having a pantograph system 14, it should be realized that automatic sheet transport mechanism 12 can be suitably adapted to advance a variety of different sheets other than paper to a variety of work machines other than a pantograph system.

Thus, while the present invention has been described with respect to an exemplary embodiment thereof, it will be understood by those of ordinary skill in the art that variations and modifications can be effected within the scope and spirit of the invention.

We claim:

1. An automatic sheet transport mechanism for an automatic signature writing machine comprising:

a flat, rectangular writing surface disposed in a horizontal plane and upon which a sheet rests while being written on, said writing surface having longitudinal sides, a leading lateral side, and a trailing lateral side;

a writing instrument located vertically above said writing surface which is movable into and out of engagement with said writing surface in a defined writing area to write a desired message;

a sheet positioning means for accurately positioning the sheet on said flat surface including a. a leading driving roller and a trailing driving roller located adjacent respective leading and trailing sides of said writing surface, each of said driving rollers being elongate, extending longitudinally of said writing surface, and having a top edge tangent to the horizontal plane of said writing surface, b. a motor means for rotating said leading and trailing rollers such that the respective top edges of said rollers rotate toward and away from said writing surface, c. a leading shaft and a trailing shaft located vertically above respective said leading and trailing rollers, and d. a pair of leading wheels and a pair of trailing wheels mounted on respective said leading and trailing shafts such that said wheels rotatably contact a respective roller, said wheels being freely rotatable on said shafts and adjustably positionable longitudinally relative to said shafts whereby the sheet is located between respective said rollers and wheels such that the rotation of said rollers cause the sheet to move laterally relative to said writing surface;

a sheet feeding means positioned adjacent said leading roller for removing a single sheet from a stack of sheets and for advancing the single sheet between said leading driving roller and associated leading wheels; and a control means for cyclically controlling the actuation of said motor means, said sheet feeding means, and said writing instrument such that the single sheet from the stack is moved by said sheet feeding means to said sheet positioning means and thereby to the writing area of said writing surface where said writing instrument writes the desired message, and thereafter said sheet positioning means is actuated to move the single sheet off of the trailing side of said writing surface and the cycle is then repeated;

said sheet positioning means further including a common mounting means for said leading shaft and said trailing shaft, said common mounting means comprising means for preventing said shafts from moving horizontally and for providing a free floating mounting for said shafts such that said shafts can move freely in a vertical direction, said wheels supporting said mounting means by exerting pressure on said respective driving rollers, said pressure being substantially equal to and determined by the weight on said wheels.

2. An automatic sheet transport mechanism as claimed in claim 1 wherein said leading driving roller rotates slightly slower than said trailing driving roller during movement of the sheet along said writing surface whereby the sheet is pulled taut by said sheet positioning means when the sheet is located between both said rollers and associated wheels.

3. An automatic sheet transport mechanism as claimed in claim 1 wherein at least one of said shafts is movable.

4. An automatic sheet transport mechanism as claimed in claim 3 and futher including a base which surrounds said writing surface; and wherein said mounting means includes a pair of opposed bars located adjacent respective longitudinal sides of said writing surface, said shafts being rotatably mounted on said bars; and wherein said mounting means includes a pair of pins extending downwardly from each of said bars, said pins being freely received in respective bores located in said base.

5. An automatic sheet transport mechanism as claimed in claim 3 wherein said sheet positioning means further includes a resilient hold-down strip extending generally parallel to said writing surface in a lateral direction and exerting a slight downward pressure on said writing surface, said hold-down strip being located in a position adjacent said writing area to hold the sheet flat against the writing surface during writing thereon.

6. An automatic sheet transport mechanism as claimed in claim 5 wherein said sheet positioning means further includes a strip attaching means for adjustably attaching one end of said strip to said leading shaft, said attaching means being adjustable longitudinally of said leading shaft to vary the position of said strip longitudinally of said writing surface and rotatably about said leading shaft to vary the pressure exerted by said resilient strip on said writing surface.

7. An automatic sheet transport mechanism as claimed in claim 5 wherein said writing instrument rests adjacent said leading shaft during movement of the sheet, and wherein said sheet positioning means further includes a protective strip which is attached to said leading shaft and which extends along said writing surface below the rest position of said writing instrument.

8. An automatic sheet transport mechanism for precisely positioning a sheet relative to an automatic work machine comprising:

a flat, rectangular work surface disposed in a horizontal plane and upon which the sheet rests while being worked on, said work surface having longitudinal sides, a leading lateral side, and a trailing lateral side;

a work instrument located vertically above said work surface which is movable into and out of engagement with said work surface in a defined work area;

a sheet positioning means for accurately positioning the sheet on said flat work surface including a. a leading driving roller and a trailing driving roller located adjacent respective leading and trailing sides of said work surface, each of said driving rollers being elongate, extending longitudinally of said work surface, and having a top edge tangent to the horizontal plane of said work surface, b. a motor means for rotating said leading and trailing rollers such that the respective top edges of said rollers rotate toward and away from said work surface, c. a leading shaft and a trailing shaft located vertically above respective said leading and trailing rollers, and d. a pair of leading wheels and a pair of trailing wheels mounted on respective ones of said leading and trailing shafts such that said wheels rotatably contact a respective roller, said wheels being freely rotatable on said shafts and adjustably positionable longitudinally relative to said shafts whereby the sheet is located between respective said rollers and wheels such that the rotation of said rollers cause the sheet to move laterally relative to said work surface;

a sheet feeding means positioned adjacent said leading roller for removing a single sheet from a stack of sheets and for advancing the single sheet between said leading driving roller and associated leading wheels, said sheet feeding means including an adjusting means for adjusting said sheet feeding means longitudinally of said work surface such that the sheet is fed to said sheet positioning means with the area of the sheet to be worked on longitudinally aligned with the work area of said work surface; and a control means for cyclically controlling the actuation of said motor means, said sheet feeding means, and said writing instrument including a. a sensing means for sensing the leading edge of the sheet relative to a known lateral position of said work area, b. an encoder means for determining the precise rotational displacement of said leading driving roller and hence the advancement of the leading edge of the sheet relative to said work area, and c. a stopping means for stopping the rotating of said leading driving roller by said motor means upon the completion of a predetermined rotational displacement of said leading driving roller after detection of the leading edge of the sheet by said sensing means, whereby the single sheet from the stack is moved by said sheet feeding means to said sheet positioning means, is thereafter moved by said sheet positioning means to the work area of said work surface where the work instrument performs the desired work, and finally moved by said sheet positioning means from the trailing side of said work surface, said sheet positioning means further including a common mounting means for said leading shaft and said trailing shaft said common mounting means comprising means for preventing said shafts from moving horizontally and for providing a floating mounting for said shafts such that said shafts move freely in a vertical direction, said wheels support said mounting means by exerting pressure on said respective driving rollers, said pressure being substantially equal to and determined by the weight on said wheels.

9. An automatic sheet transport mechanism as claimed in claim 8 wherein said sheet positioning means further includes a hold-down strip extending generally parallel to said work surface in a lateral direction and exerting a slight downward pressure on said work surface, said hold-down strip being located in a position adjacent said work area to hold the sheet flat against the work surface during the working thereon.

10. An automatic sheet transport mechanism as claimed in claim 9 wherein said sheet positioning means further includes a strip attaching means for adjustably attaching one end of said strip to said leading shaft, said attaching means being adjustable longitudinally of said leading shaft to vary the position of said strip longitudinally of said work surface.

11. An automatic sheet transport mechanism as claimed in claim 10 wherein said leading driving roller rotates slightly slower than said trailing driving roller during movement of the sheet along said work surface whereby the sheet is pulled taut by said sheet positioning means when the sheet is located between both said rollers and associated wheels.

12. An automatic sheet transport mechanism for an automatic signature writing machine comprising:

a flat, rectangular writing surface disposed in a horizontal plane and upon which a sheet rests while being written on, said writing surface having longitudinal sides, a leading lateral side, and a trailing lateral side;

a writing instrument located vertically above said writing surface which is movable into and out of engagement with said writing surface in a defined writing area to write a desired message;

a sheet positioning means for accurately positioning the sheet on said flat surface including a. a leading driving roller and a trailing driving roller located adjacent respective leading and trailing sides of said writing surface, each of said driving rollers being elongate, extending longitudinally of said writing surface, and having a top edge tangent to the horizontal plane of said writing surface, b. a motor means for rotating said leading and trailing rollers such that the respective top edges of said rollers rotate toward and away from said writing surface, c. a leading shaft and a trailing shaft located vertically above respective said leading and trailing rollers, and d. a pair of leading wheels and a pair of trailing wheels mounted on respective said leading and trailing shafts such that said wheels rotatably contact a respective roller, said wheels being freely rotatable on said shafts and adjustably positionable longitudinally relative to said shafts whereby the sheet is located between respective said rollers and wheels such that the rotation of said rollers cause the sheet to move laterally relative to said writing surface;

a sheet feeding means positioned adjacent said leading roller for removing a single sheet from a stack of sheets and for advancing the single sheet between said leading driving roller and associated leading wheels; and a control means for cyclically controlling the actuation of said motor means, said sheet feeding means, and said writing instrument such that the single sheet from the stack is moved by said sheet feeding means to said sheet positioning means and thereby to the writing area of said writing surface where said writing instrument writes the desired message, and thereafter said sheet positioning means is actuated to move the single sheet off of the trailing side of said writing surface and the cycle is then repeated, said sheet feeding means further including an adjusting means for adjusting said sheet feeding means longitudinally of said writing surface such that the sheet is fed to said sheet positioning means with the area of the sheet to be written on longitudinally aligned with the writing area of said writing surface, and said control means including a sensing means for sensing the leading edge of the sheet relative to a known lateral position of said writing area, an encoder means for determining the precise rotational displacement of said leading driving roller and hence of the advancement of the leading edge of the sheet relative to said writing area, and a stopping means for stopping the rotating of said leading driving roller by said motor means upon the completion of a predetermined rotational displacement of said leading driving roller after detection of the leading edge of the sheet by said sensing means whereby the sheet is laterally positioned on said writing surface with the portion of the sheet to be written on laterally located at the writing area of said writing surface, said sensing means also sensing the passing of the trailing edge after the writing on the sheet, and said control means actuating said sheet feeding means upon the sensing by said sensing means of the passage of the trailing edge of the sheet, said control means further including a time delay means for shutting off said sheet feeding means and said sheet positioning means when the leading edge of a succeeding sheet is not detected by said sensing means within a predetermined time period after detection by said sensing means of the passing of the trailing edge of the preceding sheet.

13. An automatic sheet transport mechanism as claimed in claim 8 and further including a base which surrounds said work surface; and wherein said mounting means includes a pair of opposed bars located adjacent respective longitudinal sides of said work surface, said shafts being rotatably mounted on said bars; and wherein said mounting means includes a pair of pins extending downwardly from each of said bars, said pins being freely received in respective bores which are located in said base and are of larger diameter than said pins so as to permit a free floating movement of said pins in a vertical direction.

14. An automatic sheet transport mechanism as claimed in claim 12 wherein said sheet feeding means further includes an elongate deflector plate mounted with one longitudinal edge adjacent and slightly above said leading driving roller and the other longitudinal edge adjacent the uppermost reach of the stacked sheets such that any sheet fed from the stack by said sheet feeding means is delivered between said leading driving roller and said leading wheels.

15. An automatic sheet transport mechanism as claimed in claim 12 wherein said stopping means includes a brake means for stopping and preventing further rotation of said motor means, said brake means being actuated by said control means.

* * * * *